US010751914B2

(12) United States Patent
Faedi et al.

(10) Patent No.: US 10,751,914 B2
(45) Date of Patent: Aug. 25, 2020

(54) MIXER BUCKET

(71) Applicant: CANGINI BENNE S.R.L., Sarsina (FC) (IT)

(72) Inventors: Marco Faedi, Cesena (IT); Davide Cangini, Mercato Saraceno (IT)

(73) Assignee: CANGINI BENNE S.R.L., Sarsina (FC) (IT)

( * ) Notice: Subject to any disclaimer, the term of this patent is extended or adjusted under 35 U.S.C. 154(b) by 280 days.

(21) Appl. No.: 15/778,880

(22) PCT Filed: Nov. 15, 2016

(86) PCT No.: PCT/IB2016/056851
§ 371 (c)(1),
(2) Date: May 24, 2018

(87) PCT Pub. No.: WO2017/093832
PCT Pub. Date: Jun. 8, 2017

(65) Prior Publication Data

US 2018/0345536 A1 Dec. 6, 2018

(30) Foreign Application Priority Data

Nov. 30, 2015 (IT) ..... UB2015A6021

(51) Int. Cl.
*B28C 5/00* (2006.01)
*B28C 5/14* (2006.01)
(Continued)

(52) U.S. Cl.
CPC ..... *B28C 5/141* (2013.01); *B01F 7/04* (2013.01); *B01F 15/00818* (2013.01);
(Continued)

(58) Field of Classification Search
CPC ..... B28C 5/141; B28C 5/0887; B28C 5/0893; B28C 5/142; B28C 7/16; B01F 7/04;
(Continued)

(56) References Cited

U.S. PATENT DOCUMENTS 1,667,959 A * 5/1928 Talbot ..... B01F 15/00818 222/505
4,214,376 A * 7/1980 Lucke ..... B01F 7/04 34/182
4,448,535 A * 5/1984 West ..... B01F 3/1271 366/13

FOREIGN PATENT DOCUMENTS

DE 4220032 2/1993
EP 2226429 9/2010

* cited by examiner

*Primary Examiner* — Anshu Bhatia
(74) *Attorney, Agent, or Firm* — Abelman, Frayne & Schwab

(57) ABSTRACT

Mixer bucket (1) provided with a hopper (12) having a concave bottom portion (120) provided with an opening (122) arranged between a first and a second continuous portions (124)(126); a funnel-shaped member (30) being carried by the concave portion (120) so as to face the opening (122) and define a gravity discharge for mixture; the funnel-shaped member (30) being carried by the hopper (12) by means of a guide (128) aligned with the given direction (D); actuating means (40) being carried by the hopper (12) to move the funnel-shaped member (30) along the guide (128) between a first position (P1), where it faces the opening (122), and a second position (P2)(P3), lateral with respect to the opening (122) in correspondence of one of the first and second flanks (14)(16).

12 Claims, 4 Drawing Sheets

(51) Int. Cl.

| | |
|---|---|
| ***B01F 15/02*** | (2006.01) |
| ***B28C 7/16*** | (2006.01) |
| ***B28C 5/08*** | (2006.01) |
| ***E02F 3/407*** | (2006.01) |
| ***E02F 7/06*** | (2006.01) |
| ***B01F 15/00*** | (2006.01) |
| ***B01F 7/04*** | (2006.01) |
| *B01F 7/00* | (2006.01) |
| *B01F 13/00* | (2006.01) |

(52) U.S. Cl.
CPC ..... *B01F 15/0267* (2013.01); *B28C 5/0887* (2013.01); *B28C 5/0893* (2013.01); *B28C 5/142* (2013.01); *B28C 7/16* (2013.01); *E02F 3/4075* (2013.01); *E02F 7/06* (2013.01); *B01F 7/00266* (2013.01); *B01F 13/0032* (2013.01); *B01F 15/00792* (2013.01); *B01F 15/0276* (2013.01)

(58) Field of Classification Search
CPC ..... B01F 15/00818; B01F 15/0267; B01F 7/00266; B01F 13/0032; B01F 15/00792; B01F 15/0276; E02F 3/4075; E02F 7/06
See application file for complete search history.

Fig.3
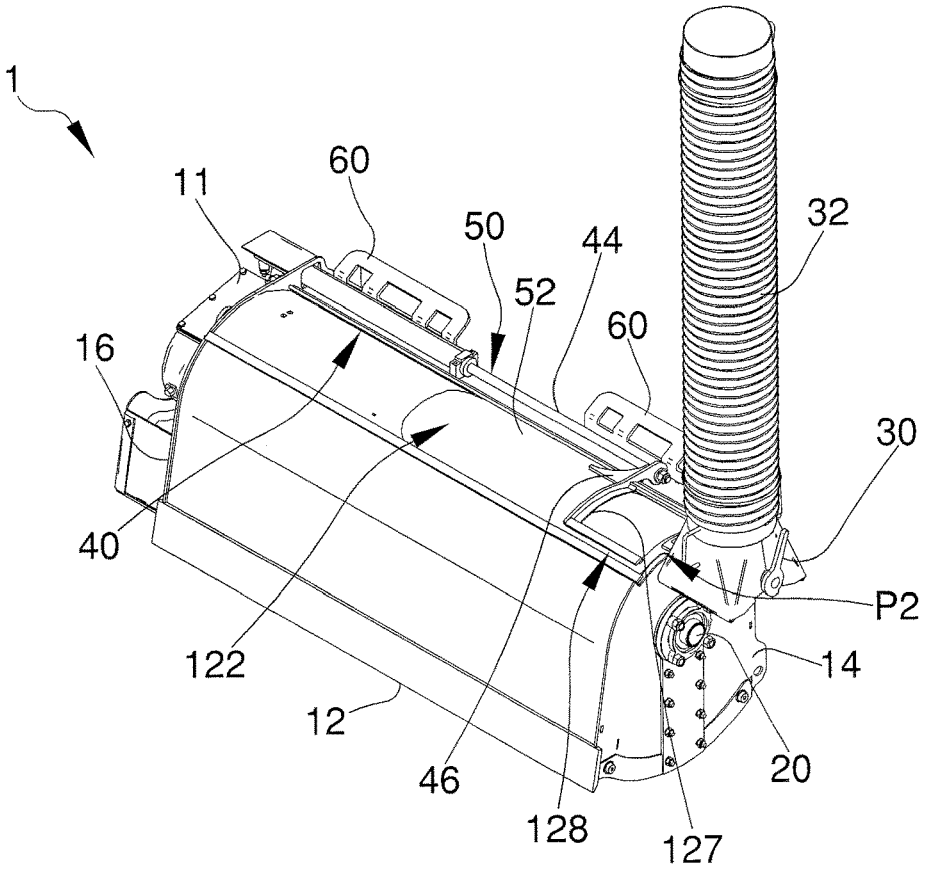
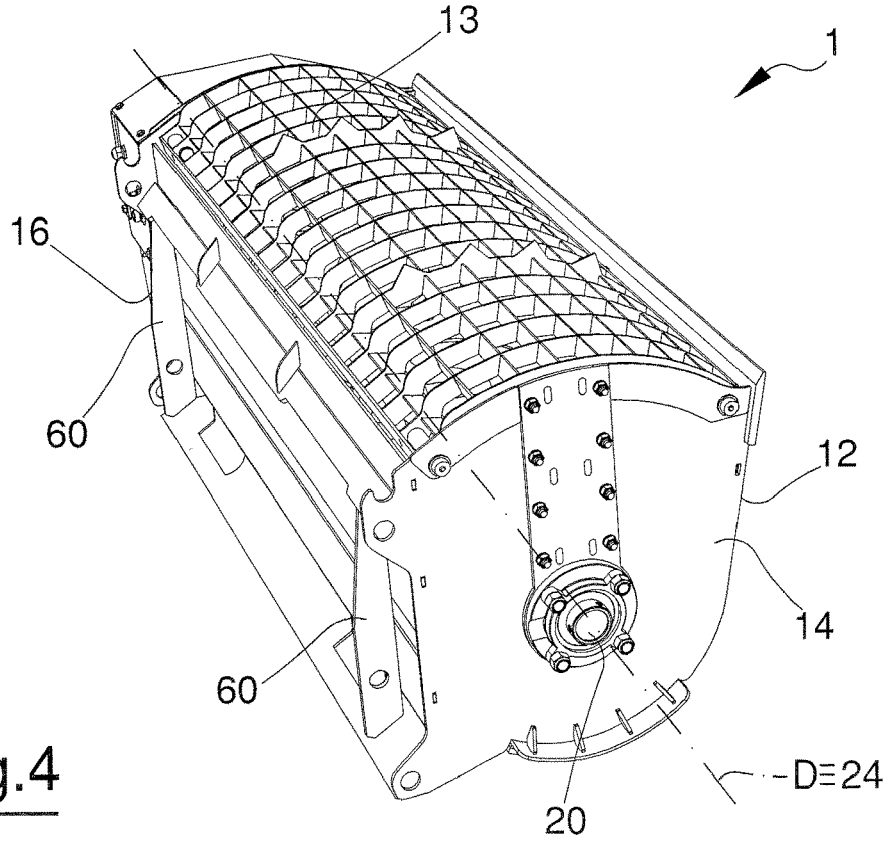
Fig.4

MIXER BUCKET

RELATED APPLICATIONS

This application is a National stage application of International Application PCT/IB2016/056851 filed Nov. 15, 2016 and claiming priority of Italian application UB2015A006021 filed Nov. 30, 2015, both applications are incorporated herein by reference thereto.

The present invention relates to a mixer bucket. In particular, the present invention relates to a mixer bucket that can be actuated by means of an articulated arm of an earthwork machine. In more detail, the present invention relates to a mixer bucket that is so designed as to be actuated by means of an articulated arm of an earthwork machine and is usable to produce cement and supply it safely through an opening provided centrally in the same mixer bucket.

BACKGROUND TO THE INVENTION

Mixer buckets are usually tools that, coupled to the ends of the arms of an excavator, allow to produce concrete after having taken sand from a deposit, having positioned the bucket with the mouth thereof facing upwards, so that it can be assimilated to a hopper, having inserted inside it cement and water, and any other ingredients necessary to obtain a concrete of given composition, and having mixed all the ingredients by means of an Archimedes' screw contained inside the bucket.

Usually, the bottom of the bucket has an opening for concrete discharge, arranged centrally, and is suitable to couple with a funnel-shaped member that, in turn, carries a discharging channel. Obviously, to perform this operation the bucket shall be raised and maintained in a position of maximal height so as to allow an operator to position the funnel-shaped member below it, i.e. to connect the funnel-shaped member to the bucket, in correspondence of the opening. This operation is particularly dangerous due to the instability of the bucket in this position, often resulting in discharging the concrete onto the operator, with sometimes fatal consequences. To avoid these terrible consequences, it has been thought to provide the opening in lateral position, in correspondence of a flank of the bucket, so as to allow an operator to stay outside the bucket's projection onto the ground, and therefore to be not subjected to any consequences in case of overturning of the bucket filled with concrete. However, providing the discharge opening of the bucket laterally, within the projection and near one of the flanks causes a not negligible inconvenience; in fact, the concrete supplied by means of the Archimedes' screw towards the lateral portion of the bucket becomes compact and loses fluidity, and it is therefore more difficult to discharge it. To avoid this inconvenience, it is necessary to activate the Archimedes' screw in opposite rotational directions, thus slowing down the times necessary for discharging.

In view of the situation described above, it would be desirable to have available a mixer bucket that, in addition to limiting and possibly overcoming the drawbacks of the prior art, defines a new standard for this kind of tools, both as regards the product and the mode of use, i.e. the method performed to mix safely the ingredients, without risks for the operator and without the need for performing operations in order to make the concrete contained inside the bucket less compact.

SUMMARY OF THE PRESENT INVENTION

The present invention relates to a mixer bucket. In particular, the present invention relates to a mixer bucket that can be actuated by means of an articulated arm of an earthwork machine. In more detail, the present invention relates to a mixer bucket that is so designed as to be actuated by means of an articulated arm of an earthwork machine and is usable to produce cement and supply it safely through an opening provided centrally in the same mixer bucket.

An object of the present invention is to provide a mixer bucket which is safe and practical to be used, which overcomes the limits of the known mixer buckets and can be produced at limited costs.

According to the present invention a mixer bucket is provided, whose main features will be described in at least one of the appended claims.

A further object of the present invention is to provide a method to produce concrete safely by using a bucket with a central opening.

According to the present invention, a method is provided to produce concrete by safely using a mixer bucket provided with a central discharge opening.

BRIEF DESCRIPTION OF DRAWINGS

Further characteristics and advantages of the mixer bucket and the corresponding method of use according to the present invention will be more apparent from the description below, set forth with reference to the attached drawings, that illustrate some examples of embodiment, where identical or corresponding parts of the equipment mentioned above are identified by the same reference numbers. In particular:

FIG. 3 is a schematic perspective view from the bottom of FIG. 1, in enlarged scale and with some parts removed for the sake of clarity, with one component in extracted position;

FIG. 4 is a perspective view of FIG. 1, with some parts removed for the sake of clarity;

DETAILED DESCRIPTION OF THE PRESENT INVENTION

Figure 1:
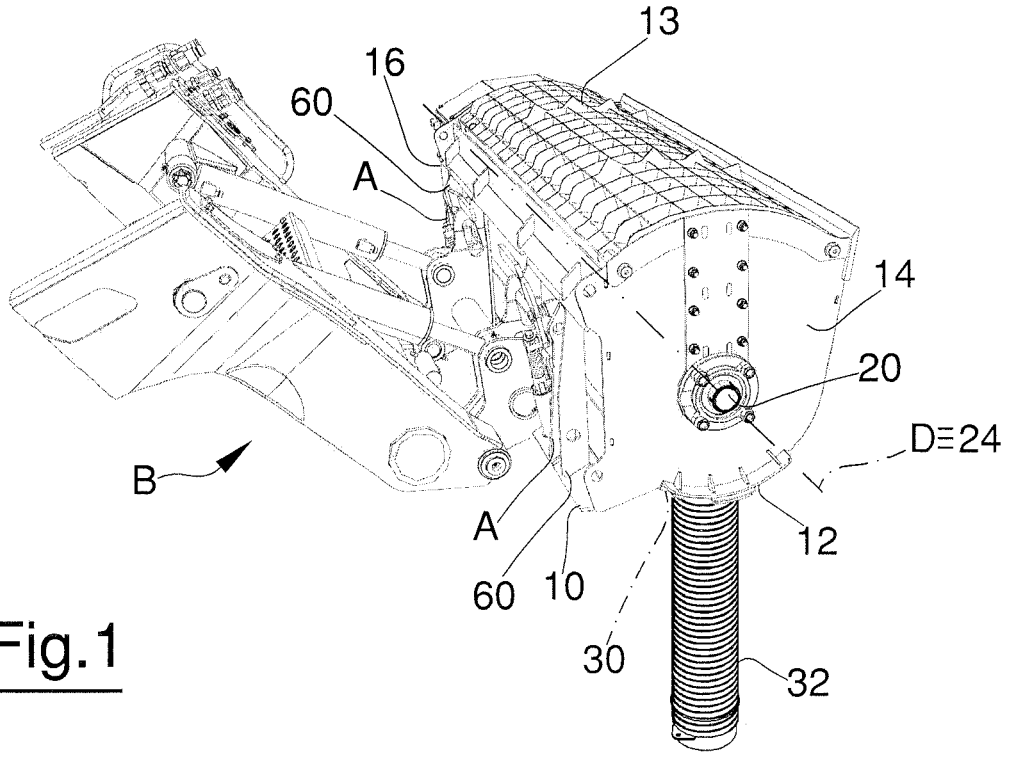
FIG. 1 is a schematic perspective view of a first preferred embodiment of a mixer bucket installed on the arm of an excavator.

In FIG. 1, number 1 indicates, in its entirety, a mixer bucket for an excavator, known and therefore not shown. The bucket 1 can be validly used to produce concrete in a safely way once the bucket has been filled with the necessary ingredients and has been adequately positioned, i.e. with an opening thereof arranged horizontal from the arms B of the excavator, as better described below.

Figure 2:
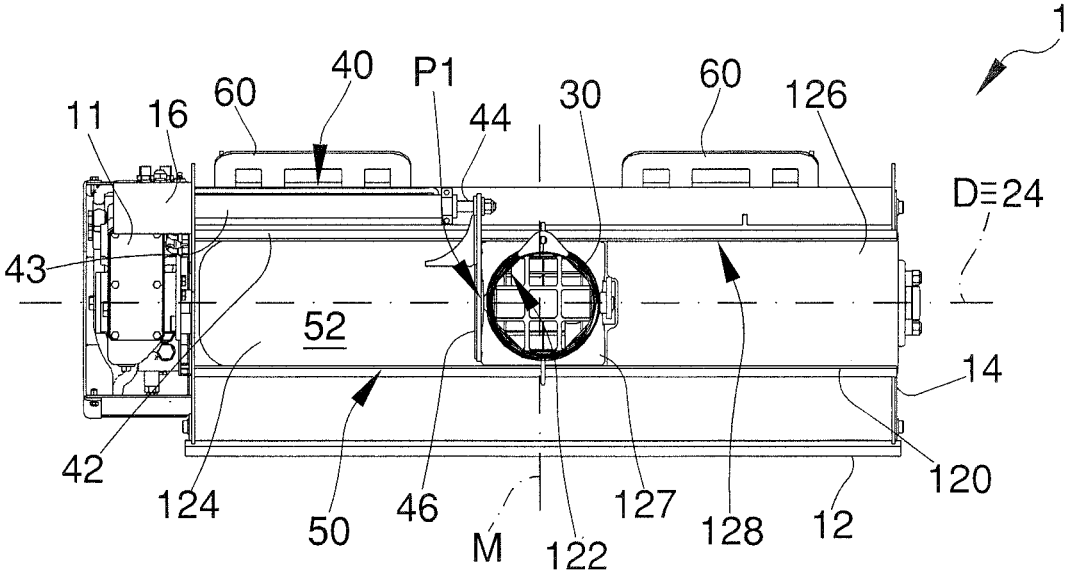
FIG. 2 is a view from the bottom of FIG. 1, in enlarged scale and with some parts removed for the sake of clarity.
Figure 5:
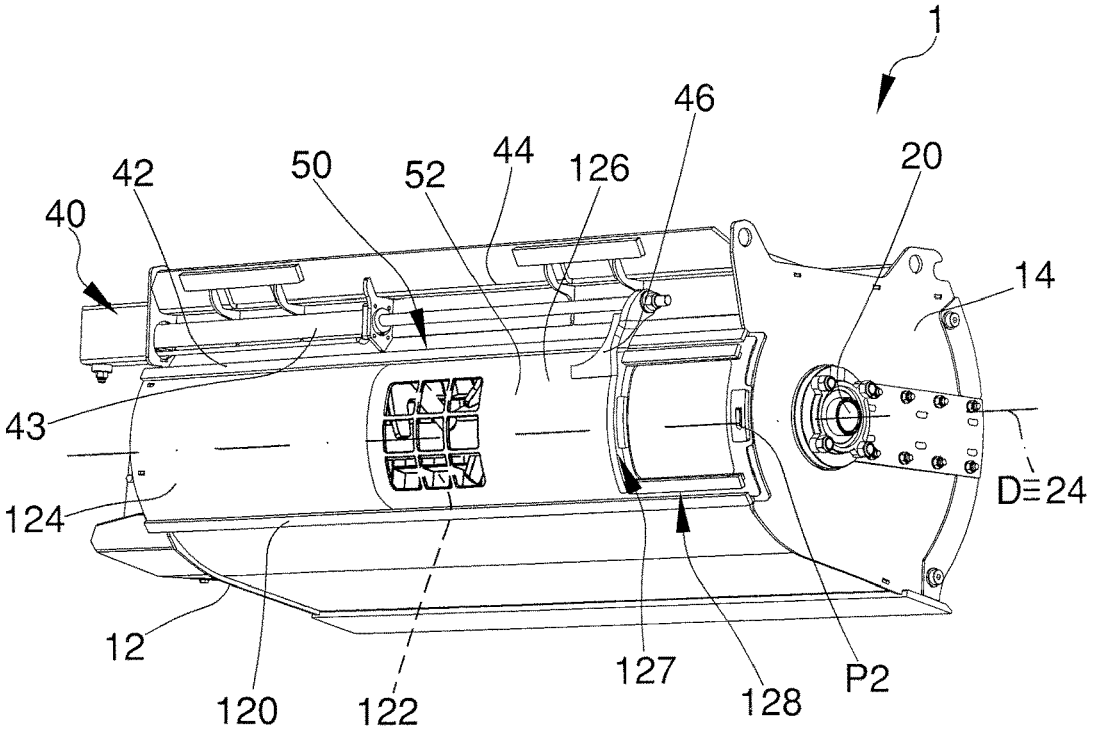
FIG. 5 is an overturned view of FIG. 4.

With reference to FIG. 1 again, the bucket 1 comprises a casing 10 provided with a hopper 12 extending in a given direction D, is closed at the top by means of a grid 13 and is delimited by a first flank 14 and by a second flank 16 aligned with the direction D and, therefore, facing each other. The flanks 14 and 16 are provided with rotatable supports for a shaft 20, which is directed parallel to the direction D and is provided with a plurality of mixing members realized by means of blades 22 arranged along the corresponding axis 24 and angularly displaced so as to mix a mixture of granular components and water contained in the hopper 12. The hopper has a concave bottom portion 120 provided with a grid-shaped opening 122 arranged centrally between the first and the second flanks 14 and 16 that therefore subdivides the bottom portion 120 into a first continuous portions 124 and a second continuous portion 126, which are symmetrical and substantially identical, and closed, as shown in FIGS. 2, 3, and 5. An actuating unit 11 is associated with the hopper 12, the actuating unit being externally coupled to the flank 16 (or indifferently to the flank 14) and designed to drive the shaft 20 into rotation. The hopper 12 carries, through the concave portion 120, a guide 128 aligned with the given direction D. A slide 127 is coupled to the guide 128 in a freely sliding manner, the slide 127 being shaped in a conjugated manner with the opening 122 and being so designed as to couple in a releasable manner with a funnel-shaped member 30. In view of the above description, the slide 127 (and therefore the funnel-shaped member 30) couples in a freely translatable manner to the bottom portion 120 along the direction D so as to define a mixture discharging portion that can be positioned at will along the bottom portion 120 and, therefore, selectively facing the opening 122 or facing one of the two continuous portions 124 and 126 (in particular facing the continuous portion 124 in FIGS. 2, 3 and 5). Moreover, an actuating device 40 is carried by the hopper 12 to move the slide 127, and therefore the funnel-shaped member 30 together with a corresponding concrete discharge channel 32, along the guide 128 between a first position P1 (FIG. 2), where it faces the opening 122, and a second position P2 (FIG. 5), lateral with respect to the opening 122 on the side of the flank 14.

According to FIGS. 2 and 5, the bucket 1 comprises a closing unit 50 associated with the slide 127 in a rigid manner, aligned with the direction D in order to close selectively the opening 30 when, in use, the funnel-shaped member 30 is arranged laterally with respect to the opening 122. The closing unit 50 comprises a guillotine-shaped element 52 that is therefore connected to the slide 127 in a rigid manner and to the guide 128 in a sliding manner, thus it is connected to the funnel-shaped member 30 on the side of the continuous portion 124 aligned with the given direction D. The guillotine-shaped element 52 is therefore always arranged at the side of the funnel-shaped member 30 so that it can be moved with this latter by means of the actuating device 40 along the given direction D, to intercept the opening 122 transversally and to prevent the mixture from being discharged through the opening 122.

In particular, the actuating device 40 comprises a linear actuator 42 directed according to the given direction D, has a casing 43 coupled to the hopper 12 and is provided with a stem 44 that is connected to the slide 127 (and therefore to the funnel-shaped element 30 and to the guillotine-shaped element 52) by means of a bracket 46 arranged between the funnel-shaped member 30 and the guillotine-shaped element 52 in a rigid manner, in order to move them together longitudinally. In view of the description above, it is easily understood that an operator can actuate the linear actuator 42 so that the slide 127 faces the opening 122, in order to enable the bucket 1 to discharge the concrete contained inside the hopper 12 through the funnel-member 30, only after he/she has moved to a remote position from the bucket 1, i.e. he/she is in safety position, if necessary working from the excavator cab.

Figure 6:
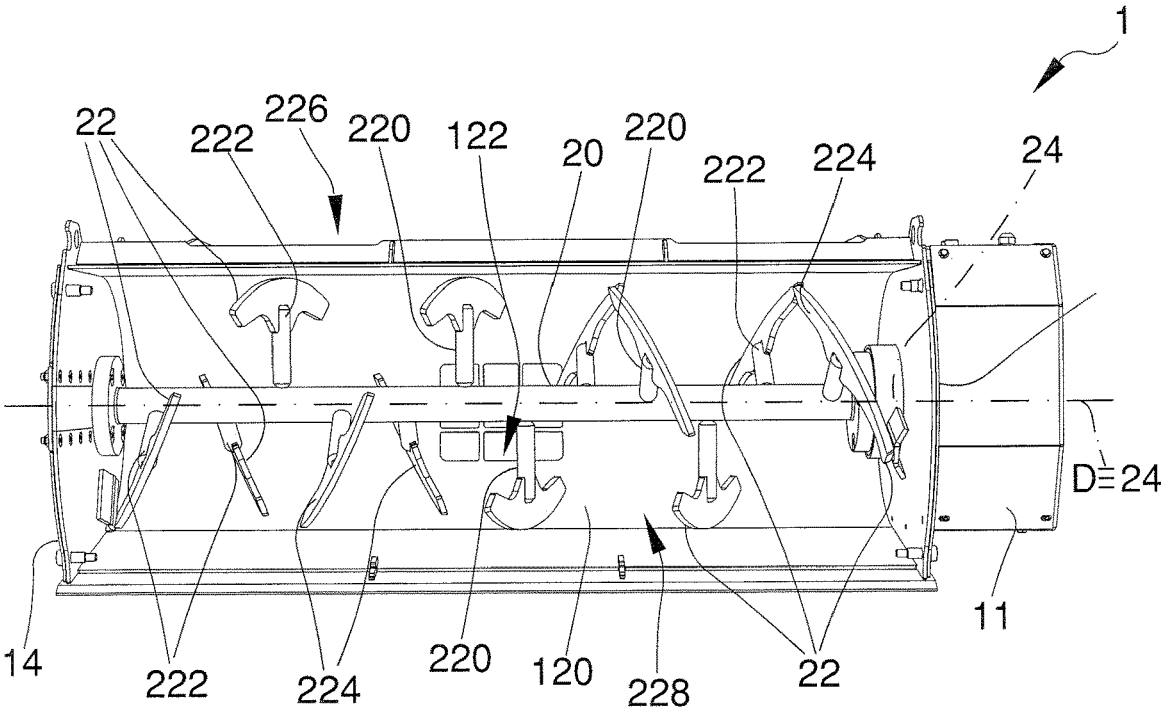
FIG. 6 is a plan view of FIG. 1, with some parts removed for the sake of clarity.

With particular reference to FIG. 6, each of the blades 22, whose set replaces an Archimedes' screw, comprises a cylindrical portion 220 to couple to the shaft 20 and has an end 222 engaged by an arched portion 224. The blades 22 can be subdivided into a first group 226 and a second group 228 arranged at opposite sides from the opening 122; it should be noted that the arched portions 224 of the first group 226 or of the second group 228 are respectively aligned with substantially helical profiles that are concentric with the shaft 20 and whose distance from one another decreases towards the opening 122, and are arranged symmetrically with respect to the opening 122 so as to supply, in use, the mixture towards the opening 122 to facilitate the discharge thereof. In case each branch of the shaft 20 has an equal number of blades 22, the blades 22 of each first or second group 226/228 equidistant from a median plane M cutting the opening 122 can be provided with the respective arched portions 224 arranged symmetrically with respect to the median plane M and rotated by 180° with respect to the corresponding coupling portions 120. In this way, the blades 22 move the concrete towards the centre of the hopper 12, and the concrete increases in volume and spontaneously flows from the centre on the sides of the bucket 1 towards the flanks 14 and 16.

With reference to FIG. 1 and to FIG. 4, it should be specified that a pair of metal brackets 60 are associated with the hopper 12, the brackets being so shaped as to couple to couplings A of the arms B of an excavator, known and therefore not shown.

The use of the bucket 1 is clearly apparent from the description above and does not require further explanations. However, it should be specified that the funnel-shaped member 30 may be coupled to the hopper 12, with the opening 122 shielded, through the actuating member 52, by working laterally with respect to the bucket 1 and therefore in a completely safe position for the operator, even if within the projection of the bucket 1 in its entirety, in order to facilitate the effectiveness of the bucket 1 even when, in use, the slide 127 is in the second position P2. In fact, the operator can control the concrete discharge only after having moved the closing member 52 from the position where it faces the opening 122 to a position where it faces the continuous portion 124 by means of the linear actuator 42, therefore by means of a fluid-dynamic device that can be controlled remotely, always remaining far from the bucket 1, in safety conditions.

In view of the above description it is clearly apparent that variants and modifications can be done to the bucket according to the present invention without however departing from the protective scope of the invention.

Figure 7:
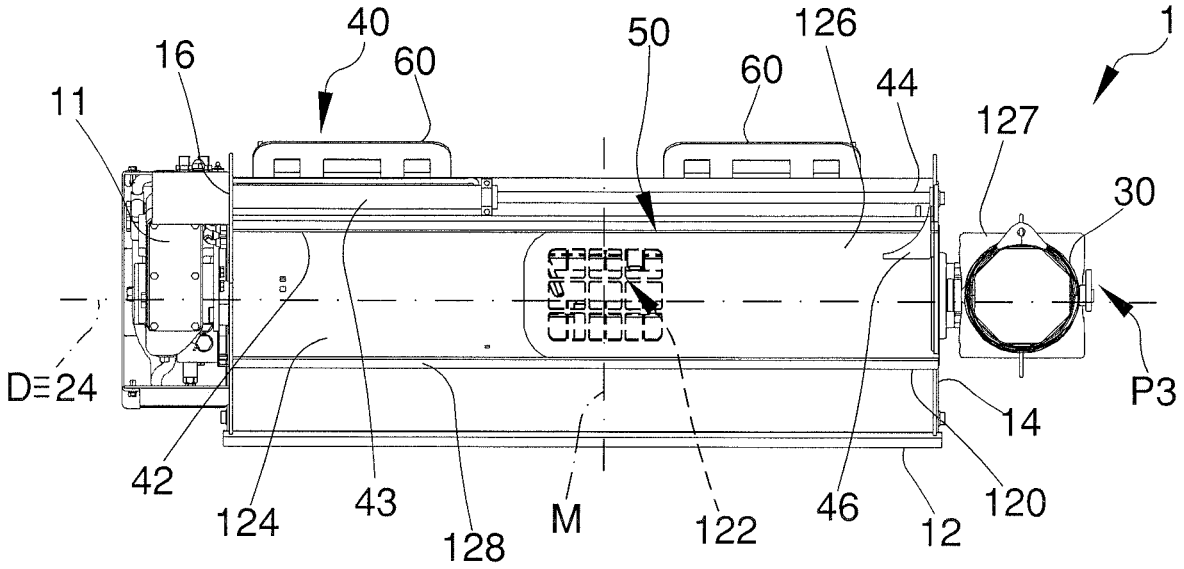
FIG. 7 is a view from the bottom of a second preferred embodiment of FIG. 1.

For instance, with reference to FIG. 7 a second embodiment of the bucket 1 is illustrated, wherein the closing member 52 and the slide 127 are so shaped that the slide 127 can be arranged in the third position P3 (FIG. 7) completely at the side and outside the projection of the bucket 1.

Positioning the slide 127 in this way forces the user to move outside of the projection of the bucket 1 on the ground, while the user prepares the slide 127 with the funnel-shaped member 30. In FIG. 7, the closing member 52 has been elongated so as to keep the opening 122 closed when the slide 127 keeps the funnel-shaped member 30 in position P3, always for safety reasons. On the other hand, if the preparation of the slide 127 is made when the bucket 1 is not filled, the closing member may have a longitudinal extension equal to the extension of the version described with reference to FIGS. 1-6.

With reference to what described above, it should be specified that to provide a mixer bucket as described above with reference to the bucket 1 has unquestionable advantages, both for the fact that the safety of use is absolutely improved, as the closing element 52 prevents the concrete discharge from the opening 122, and because this opening is positioned laterally, allowing each user to perform the operations of preparation of the bucket for the discharge when the bucket has been already filled by means of devices that can be controlled remotely, remaining outside of the projection of the bucket on the ground, and therefore in a safety position. Moreover, the fact of keeping the opening 122 centrally and of having replaced the Archimedes' screw with a shaft 20 provided with blades 22 directed opposite to each other allows to supply the concrete to the opening 122 avoiding to make it too much compact on the side of the bucket 1 and therefore avoiding the breakage of the mixing shaft 20 due to an excessive stress acting on the thrust elements.

In view of the above description, the mixer bucket 1 overcomes the drawbacks of the prior art illustrated above and defines a new economical solution as regards both the product and the mode of use, i.e. the method that can be performed to mix the ingredients and to discharge the concrete completely safely, with absolutely no risks for the operator and without the need for making the concrete less compact before discharging it.

The invention claimed is:

1. Mixer bucket (1) provided with a hopper (12) extending in a given direction (D) and delimited by a first flank (14) and a second flank (16) facing each other; said hopper (12) having a concave bottom portion (120) provided with an opening (122) arranged between said first and second flanks (14)(16) between a first and a second continuous portions (124)(126) of said bottom portion (120); a funnel-shaped member (30) being carried by said concave portion (120) so as to face said opening (122) and define a gravity discharge for mixture; characterized in that said funnel-shaped member (30) is carried by said hopper (12) by means of a guide (128) aligned with said given direction (D); actuating means (40) being carried by said hopper (12) to move said funnel-shaped member (30) along said guide (128) between a first position (P1), where it faces said opening (122), and a second position (P2)(P3), lateral with respect to said opening (122) in correspondence of one of said first and second flanks (14)(16).

2. Bucket according to claim 1, characterized in that said second lateral position (P2) lies within the projection of said bottom portion (120).

3. Bucket according to claim 1, characterized in that said second lateral position (P3) is arranged at the side of, and outside, said bottom portion (120).

4. Bucket according to claim 1, characterized by comprising closing means (50) associated with said hopper (12) and aligned to said given direction (D) to close said opening (122) selectively when, in use, said funnel-shaped member (122) is arranged at the side of said opening (122).

5. Bucket according to claim 4, characterized in that said closing means (50) comprise a guillotine-shaped element (52) that is laterally connected to said funnel-shaped member (30) so that it can be moved with it by means of said actuating means (40) along said given direction (D) to intercept said opening (122) selectively and, in this case, to prevent the mixture from being discharged.

6. Bucket according to claim 5, characterized in that said actuating means (40) comprise a linear actuator (42) directed according to said given direction (D), carried by said hopper (12) and provided with a stem (44) that is connected to said funnel-shaped member (30) and to said guillotine-shaped element (52), in order to move them together longitudinally.

7. Bucket according to claim 1, characterized by comprising a shaft (20) supported by said first flank (14) and second flank (16) and provided with mixing means (22) that are arranged along a respective axis (24) to mix a mixture of granular components and water contained in said hopper (12); said mixing means (20) comprising blades (22) carried by said shaft (20).

8. Bucket according to claim 7, characterized in that each said blade (22) comprises a coupling portion (220) to couple to said shaft (20) and has an end (222) engaged by an arched portion (224).

9. Bucket according to claim 8, characterized in that said blades (22) can be subdivided into a first group (226) and a second group (228) arranged at opposite sides from said opening (122); said arched portions (224) of each said first or second group (226) (228) being directed according to profiles concentric with said shaft (20) in order to supply said mixture, in use, towards said opening (122).

10. Bucket according to claim 9, characterized in that said arched portions (224) of each said first or second group (226) (228), that are equidistant from a median plane (M) cutting said opening (122), are arranged symmetrically with respect to said median plane (M) and rotated by 180° with respect to the corresponding coupling portions (120).

11. Bucket according to claim 1, characterized by comprising driving means (11) suitable to rotate said shaft (20) and arranged laterally in association with one of said first and second flanks (14) (16).

12. Bucket according to claim 1, characterized in that said funnel-shaped member (30) is carried by said guide (128) through the interposition of a slide (127).

* * * * *